US009480116B2

(12) United States Patent
Vissenberg et al.

(10) Patent No.: US 9,480,116 B2
(45) Date of Patent: Oct. 25, 2016

(54) DIMMER CONTROL OF ANGULAR DISTRIBUTION OF LIGHT

(75) Inventors: Michel Cornelis Josephus Marie Vissenberg, Roermond (NL); Johannes Petrus Maria Ansems, Hulsel (NL); Ramon Pascal van Gorkom van Gorkom, Eindhoven (NL); Anthonie Hendrik Bergman, Nuenen (NL); Marcellinus Petrus Carolus Michael Krijn, Eindhoven (NL); Teunis Willem Tukker, Eindhoven (NL)

(73) Assignee: KONINKLIJKE PHILIPS ELECTRONICS N.V., Eindhoven (NL)

( * ) Notice: Subject to any disclaimer, the term of this patent is extended or adjusted under 35 U.S.C. 154(b) by 240 days.

(21) Appl. No.: 14/007,718

(22) PCT Filed: Mar. 23, 2012

(86) PCT No.: PCT/IB2012/051391

§ 371 (c)(1),
(2), (4) Date: Sep. 26, 2013

(87) PCT Pub. No.: WO2012/131549

PCT Pub. Date: Oct. 4, 2012

(65) Prior Publication Data

US 2014/0015436 A1 Jan. 16, 2014

(30) Foreign Application Priority Data

Mar. 30, 2011 (EP) ..... 11160362

(51) Int. Cl.
*H05B 41/16* (2006.01)
*H05B 33/08* (2006.01)
*H05B 37/02* (2006.01)

(52) U.S. Cl.
CPC ..... *H05B 33/0845* (2013.01); *H05B 37/02* (2013.01); *H05B 37/029* (2013.01)

(58) Field of Classification Search
CPC ..... H05B 33/0818; H05B 33/0821; H05B 33/0827
USPC ..... 315/250, 291, 294, 297
See application file for complete search history.

(56) References Cited

U.S. PATENT DOCUMENTS 7,288,902 B1 * 10/2007 Melanson ..... H03K 17/18 315/224
7,667,408 B2 2/2010 Melanson et al.
(Continued)

FOREIGN PATENT DOCUMENTS

DE 102005041234 A1 3/2007
EP 1764552 A1 3/2007
(Continued)

*Primary Examiner* — Lincoln Donovan
*Assistant Examiner* — Thomas Skibinski

(57) ABSTRACT

A method for controlling an angular distribution of a light-beam emitted by a light-output device (102, 200) comprising a first set of light-sources (105, 211) comprising at least one light-source configured to emit light within a first angular range (221, 231, 241) and second set of light-sources (107, 210) comprising at least one light-source configured to emit light within a second angular range (222, 232, 242), wherein the first angular range is different from the second angular range. The method comprises the steps of: receiving (401) a dimmer setting ($V_{DS}$) from a dimmer (101); controlling (404), if the dimmer setting is within a first predetermined range, the first set of light-sources to emit light within the first angular range; and controlling (405), if the dimmer setting is within a second predetermined range, the second set of light-sources to emit light within the second angular range. Through the method according to the invention the angular distribution of light emitted from a single light-output device may be controlled using a single switch, thereby avoiding the need for having a plurality of switches and/or new wiring which would otherwise be required.

15 Claims, 4 Drawing Sheets

(56) References Cited

U.S. PATENT DOCUMENTS

| | | | | |
|---|---|---|---|---|
| 8,820,963 | B2 * | 9/2014 | Olsen | F21V 5/007 315/151 |
| 2005/0265024 | A1 | 12/2005 | Luk | |
| 2007/0195527 | A1 | 8/2007 | Russell | |
| 2010/0213872 | A1 * | 8/2010 | Heider | B60Q 1/12 315/297 |

FOREIGN PATENT DOCUMENTS

| | | | |
|---|---|---|---|
| JP | 2010287372 | A | 12/2010 |
| KR | 2007097603 | A | 10/2007 |
| WO | 2008129485 | A1 | 10/2008 |
| WO | 2009059465 | A1 | 5/2009 |
| WO | 2009081329 | A1 | 7/2009 |
| WO | 2011010247 | A2 | 1/2011 |

* cited by examiner

DIMMER CONTROL OF ANGULAR DISTRIBUTION OF LIGHT

FIELD OF THE INVENTION

The present invention relates to a light-output device having a controllable angular light distribution and to a method for controlling an angular light distribution of a light-output device.

BACKGROUND OF THE INVENTION

Conventional lighting systems including fluorescent lamps have been used for decades but are expected to be replaced by LED-based luminaries in the future. Typically, such LED-based luminaries include a plurality of LEDs.

In lighting systems for home applications the lighting should preferably be adaptable as many rooms are used for multiple purposes. Hence, in order to meet these requirements, a dimmer switch is commonly installed and used to control the level of light in a room.

In the field of lighting for interior and exterior, there is an increasing need for lighting systems having a specific design and function. For example, in an office environment it is often desirable to provide direct lighting for workspaces as well as indirect lighting for general illumination. Hence it would be desirable to provide a lighting system which can be controlled to emitted light in several directions as desired.

EP 1 764 552 discloses an electrical configuration of a lamp or light source including four lighting units and a control unit having four switches for selectively applying electrical power to a respective one of the lighting units. However, such control of each individual lighting unit requires a complex electrical system having a plurality of light switches and complex electrical wiring, which, of course, is usually not present in a normal home or office.

SUMMARY OF THE INVENTION

In view of the above-mentioned and other drawbacks of the prior art, a general object of the present invention is to provide an improved light-output device, in particular having a controllable angular light distribution.

According to a first aspect of the invention, this and other objects are achieved through a method for controlling an angular light distribution of a light-beam emitted by a light-output device comprising a first set of light-sources comprising at least one light-source configured to emit light within a first angular range, and a second set of light-sources comprising at least one light-source configured to emit light within a second angular range, wherein the first angular range is different from the second angular range, comprising the steps of: receiving a dimmer setting from a dimmer; controlling, if the dimmer setting is within a first predetermined range, the first set of light-sources to emit light within the first angular range; and controlling, if the dimmer setting is within a second predetermined range, the second set of light-sources to emit light within the second angular range.

The term "dimmer" should, in the context of the present invention, be understood as any continuously or stepwise adjustable electrical switch.

Through the method according to the invention the angular distribution of light emitted from a single light-output device may be controlled using a single switch, thereby avoiding the need for having a plurality of switches and/or new wiring which would otherwise be required. Thus, the inventive concept of using a dimmer switch, commonly installed in homes and offices, for controlling the angular distribution of light emitted from a single light-output device, is indeed economical advantageous, and allows the user to control the lighting in a room in a very convenient and easy manner. For example, an existing dimmer switch may advantageously be used.

Since the first angular range of light is different from the second angular range of light, a user can, using a dimmer switch, for example, control the lighting in a room such that a particular area of a room is illuminated as desired. For example, the user may opt to only illuminate one of a first and a second area of a room, corresponding to a first and a second angular range of light, respectively, or the user may opt to illuminate both the first and the second area of the room, in any case, a desirable illumination of the room to fit with a particular activity and/or saving energy may be achieved.

Accordingly, the second predetermined range of the dimmer setting may correspond to controlling only the second set of light-sources, however, another predetermined range may correspond to controlling both the first set of light-sources and the second set of light-sources.

The transition from emitting light within a first angular range to emitting light within a second angular range may preferably be smooth and so the intensity of the light emitted from a first and second set of light-sources may vary within the respective first and respective second predetermined range. For example, as a user turns the dimmer setting on the dimmer switch from a first predetermined range to a second predetermined range, the intensity of light emitted within the first angular range may gradually be decreased whilst the intensity of light emitted within the second angular range may gradually be increased.

In embodiments of the invention, the first and second angular ranges of light may correspond to a first polar angular range and a second polar angular range, respectively, with reference to an optical axis of the light-output device. For example, the second polar angular range may encompass larger polar angles than the first polar angular range, and thus, by sequentially activating the respective first and respective second set of light-sources, the light-beam emitted from the light-output device may be increased in size, i.e. from a narrow to a wider beam. Alternatively, sequentially activating the respective first and respective second set of light-sources may result in that the angular distribution of the light-beam emitted from the light-output device may be changed from, for example, being substantially parallel to the optical axis of the light-output device to being substantially perpendicular thereto. In another embodiment, the first polar angular range may be centered around 0° (downwards) with reference to the optical axis of the light-output device and the second range may be centered around 180° (upwards) with reference to the optical axis of the light-output device.

In embodiments of the invention, the first and second angular ranges of light may both correspond to light centered around the same polar angle with reference to an optical axis of the light-output device, and the first and second angular ranges may correspond to light centered around a first azimuth angle and a second azimuth angle, respectively, with reference to an azimuth axis of the light-output device. Thus, by sequentially activating the respective first and respective second set of light-sources, the light-beam emitted from the light-output device may be swept around the optical axis.

It should be noted that the terms "polar angle" and "azimuth angle" as referred to herein should be understood as known mathematical terms used to define a position in a spherical coordinate system, wherein the optical axis is perpendicular to the azimuth axis.

According to embodiments of the invention, the dimmer setting may be indicative of a duty cycle of mains power. Typically, the first predetermined range of the dimmer setting corresponds to a first predetermined range of a first duty cycle as a percentage of the total sine waveform. Thus, such dimmer setting corresponds to or is equivalent to that of a conventional dimmer switch which is known to the person skilled in the art.

According to a second aspect of the present invention, the above-mentioned and other objects are achieved through a control unit for controlling a first set of light-sources comprising at least one light-source configured to emit light within a first angular range and a second set of light-sources comprising at least one light-source configured to emit light in a second angular range, wherein said control unit has an input for receiving a dimmer setting from a dimmer; and processing circuitry configured to: evaluate the dimmer setting; if the dimmer setting is within a first predetermined range, control the first set of light-sources to emit light within the first angular range; and if the dimmer setting is within a second predetermined range, control the second set of light-sources to emit light in the second angular range.

The process circuitry may evaluate the dimmer setting by first identifying the duty cycle of the altered waveform of the dimmer setting, and subsequently map the duty cycle using a so-called look-up table wherein a predetermined range of the duty cycle represents control of a particular set of light-sources. In alternative embodiments, the altered waveform of the dimmer setting may first be converted, by an analog-to-digital converter, into digital data which in turn may correlate to control of a particular set of light-sources.

The control unit may advantageously be comprised in a light-output device, further comprising a first set of light-sources comprising at least one light-source configured to emit light within a first angular range and a second set of light-sources comprising at least one light-source configured to emit light within a second angular range.

By "set of light-sources" should be understood one or a plurality of light sources.

Typically, the light-output device may comprise a plurality of sets of light-sources, for example in the range of from 2 to 100, all comprising at least one light-source configured to emitted light in different angular ranges and each controllable through a respective predetermined range of the dimmer setting. It should be noted that the above light-output device is not limited to only emit light through one set of light sources at any given time, as according to embodiments of the invention, a predetermined range of the dimmer setting may correspond to controlling a plurality of sets of light-sources to emit light in their corresponding direction simultaneously.

The light-sources in a set of light-sources may be individually configured to achieve a desirable total illumination pattern output from the set of light-sources.

According to embodiments of the invention, at least one of the first and second set of light-sources may comprise an optical element configured to redirect light from the first and/or the second set of light-sources to the first and/or the second angular range.

Thereby, the illumination pattern output from the first and/or the second set of light-sources may be further configured.

In embodiments of the invention the first and/or the second set of light-sources may comprise at least one LED.

In embodiments of the invention the control unit may further comprise a mains power input, thus electrically connectable to the AC mains power for powering the first and second set of light-sources, and in which case, the dimmer setting is used to regulate the power supply from the mains power to the first and second set of light-sources.

A conventional dimmer provides, depending on the setting of the dimmer, different levels of power supply, through varied duty cycles of the mains power, to a lamp, which power supply thus corresponds to a given level of illumination. However, when a dimmer switch is used to control the direction of light from a light-output device as described above, the power consumption may not change as the angular range of light is changed in response to a change of the setting of the dimmer switch, in fact, the power consumption may be constant regardless of the setting of the dimmer switch, and as a consequence, at some dimmer settings the power level provided through the dimmer switch to the light sources may be insufficient. Thus, by connecting light-sources to an "external" AC power mains this may be avoided and the power to the light-sources may be secured. However, in such arrangement, a dimmer setting from a dimmer can still be used to control the angular distribution of light emitted by a light-output device comprising the light-sources, i.e. to regulate which one of the and second set of light-sources that is powered through the "external" AC power mains.

The invention also relates to a lighting system comprising: the light-output device according to the invention; and a dimmer for enabling user control of the angular light distribution from the light-output device. Effects and features of such lighting system are largely analogous to those described above in connection with the first and second aspects of the invention.

BRIEF DESCRIPTION OF THE DRAWINGS

These and other aspects of the present invention will now be described in more detail, with reference to the appended drawings showing exemplary embodiment(s) of the invention, wherein.

DESCRIPTION OF EXAMPLE EMBODIMENTS OF THE PRESENT INVENTION

In the following description, the present invention is described with reference to a method for controlling an angular light distribution of a light-beam emitted by a light-output device.

Figure 1:
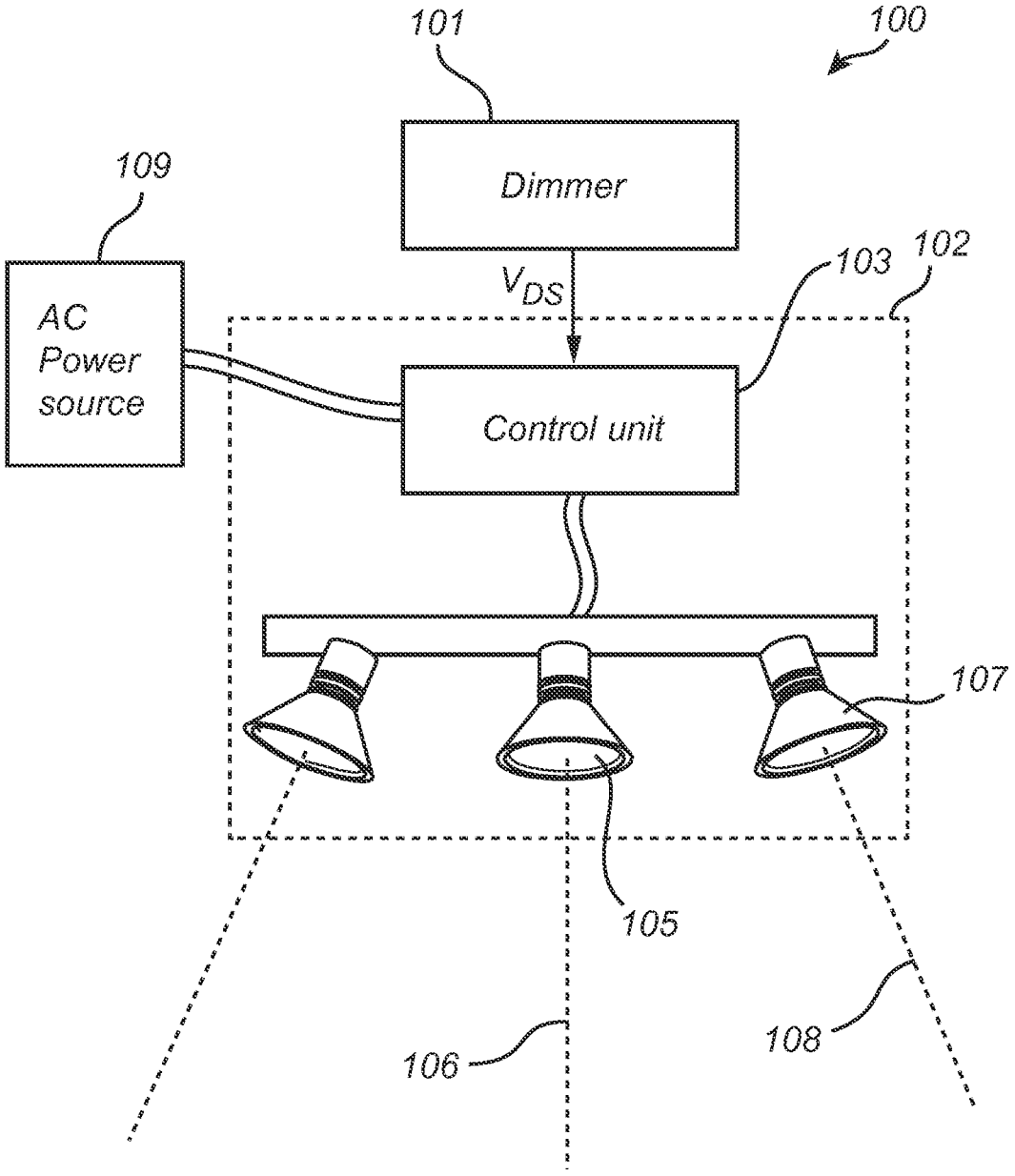
FIG. 1 schematically illustrates an exemplary embodiment of a lighting system according to the present invention.

FIG. 1 shows an exemplary embodiment of a lighting system 100 according to the invention comprising a dimmer 101 configured to output a dimmer setting $V_{DS}$, and a light-output device 102 comprising a first set of light-sources 105 configured to emit light within a first angular range indicated by the general direction of light 106, and second set of light-sources 107 configured to emit light within a second angular range indicated by the general direction of light 108. Also comprised in the light-output device 102 is a control unit 103, which receives and evaluates the dimmer setting $V_{DS}$ from the dimmer 101 and, based on the evaluation, controls the first set of light-sources 105 to emit light within the first angular range and/or controls the second set of light-sources 107 to emit light within the second angular range.

The dimmer switch 101 is typically commercially available, wherein a certain dimmer setting on the dimmer switch corresponds a certain duty cycle as a percentage of the total sine waveform, that is, a certain dimmer setting corresponds to a certain alteration of the AC waveform such that only a corresponding fraction of the complete waveform reaches the load. Thus, the power from the dimmer switch to light-output device 102 will vary accordingly. However, the power consumption may be constant regardless if the light-output device emits light within a first or a second angular range, through the first 105 and second 107 set of light-sources, respectively. Thus, as shown in FIG. 1, the power supply to the light-output device may instead be provided through an external AC power source 109, and consequently, in such arrangement, the altered AC waveform from the dimmer only functions as a control signal to control for the control unit to control the angular distribution of the light-output device.

Figure 2A:
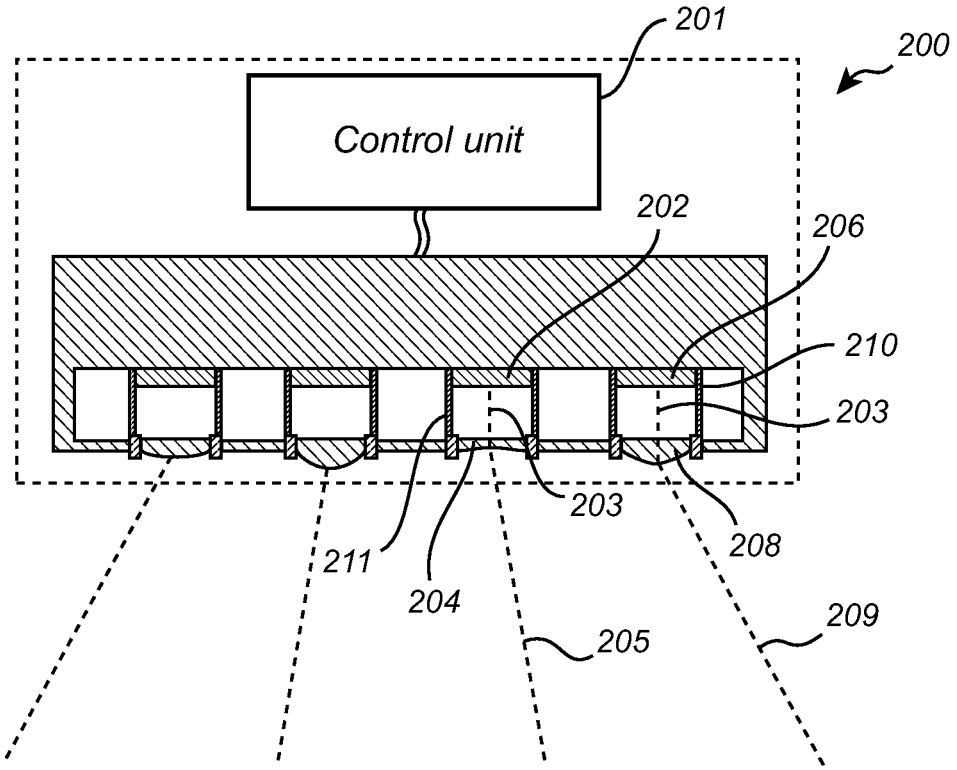
FIGS. 2*a-d* are schematic illustrations of exemplary embodiments of the light-output device according to the present invention.

FIG. 2*a* shows a side view of one embodiment of the light-output device 200 according to the invention comprising a first light-source 211 comprising a LED 202 configured to emit light within an angular range indicated by the general direction of light 203 and a first optical element 204 arranged to redirect light 203 emitted from the LED 202 to a first angular range indicated by the general direction of light 205. The light-output device 200 also comprises a second light-source 210 comprising a LED 206 configured to emit light within an angular range indicated by the general direction of light 203 and a second optical element 208 arranged to redirect light 203 emitted from the LED 206 to a second angular range indicated by the general direction of light 209. Accordingly, as shown in FIG. 2*a*, light 203 emitted from a first 211 and a second 210 light-source in a light-output device 200 can easily be directed as desired using any suitable optical element. The use of optical elements, as described above, may, for example, be advantageous in a light-source having non-adaptable LED which emit light only in predetermined angular ranges which may not be desirable for a given application. It should be noted that according to embodiments of the invention the first set of light-sources and the second set of light-sources may both comprise a plurality of light-sources configured to emit light within the same angular range as long as at least one of the light-sources in a first set of light-sources and at least one of the light-sources in a second set of light-sources is configured to emit light within a first angular range and a second angular range, respectively, which first and second angular ranges are different, thus the first and second set of light-sources generate, at least to some extent, different total illumination patterns. The light-output device in FIG. 2*a* also comprises a control unit 201 for receiving and evaluating a dimmer setting from a dimmer, and for controlling the first 211 and second 210 set of light-sources to emit light.

Figure 2C:
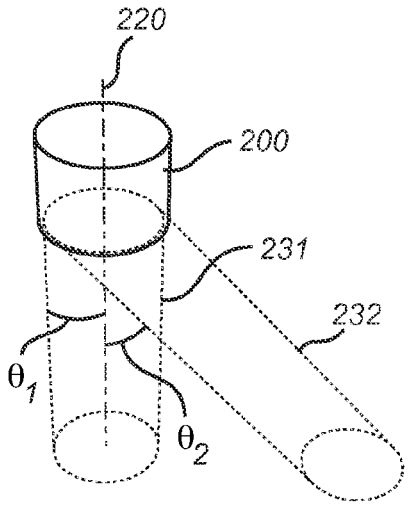
Figure 2B:
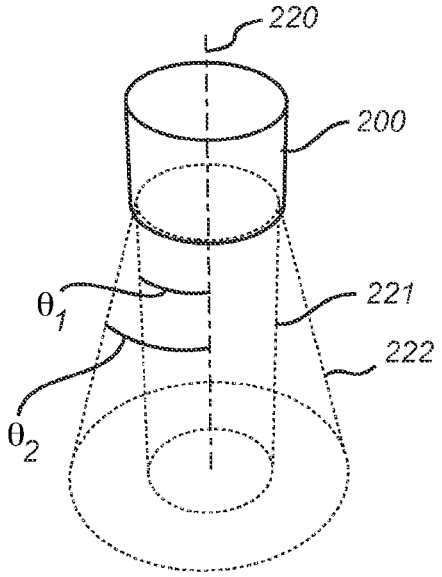

FIG. 2*b* depicts an embodiment of the light-output device 200 according to the invention, wherein the emitted light-beam is symmetrical around an optical axis 220 of the light-output device 200, and wherein a first set of light-sources (not shown) is configured to emit light within a first angular range 221 corresponding to a first polar angle range $\theta_1$ with reference to the optical axis 220, and wherein a second set of light-sources (not shown) is configured to emit light within a second angular range 222 corresponding to a second polar angle range $\theta_2$ with reference to the optical axis 220. As is exemplified in FIG. 2*b*, the second polar angle range $\theta_2$ is larger than the first polar angle range $\theta_1$, and consequently, the light-beam emitted from the light-output device can be increased in size by switching the dimmer setting from a first predetermined range to a second predetermined range corresponding to activation of a first and second set of light-sources, respectively.

An alternative embodiment of the light-output device 200 is shown in FIG. 2*c* wherein the first 231 and second 232 angular ranges of light emitted from the light-output device correspond to light centered around a first polar angle $\theta_1$ and a second polar angle $\theta_2$, respectively, with reference to an optical axis 220 of the light-output device. Hence, by sequentially activating the respective first and respective second set of light-sources, the light-beam emitted from the light-output device 200 can be swept from being centered around the first polar angle $\theta_1$(which is equal to 0° in FIG. 2*c*) to being centered around the second polar angle $\theta_2$.

Figure 2D:
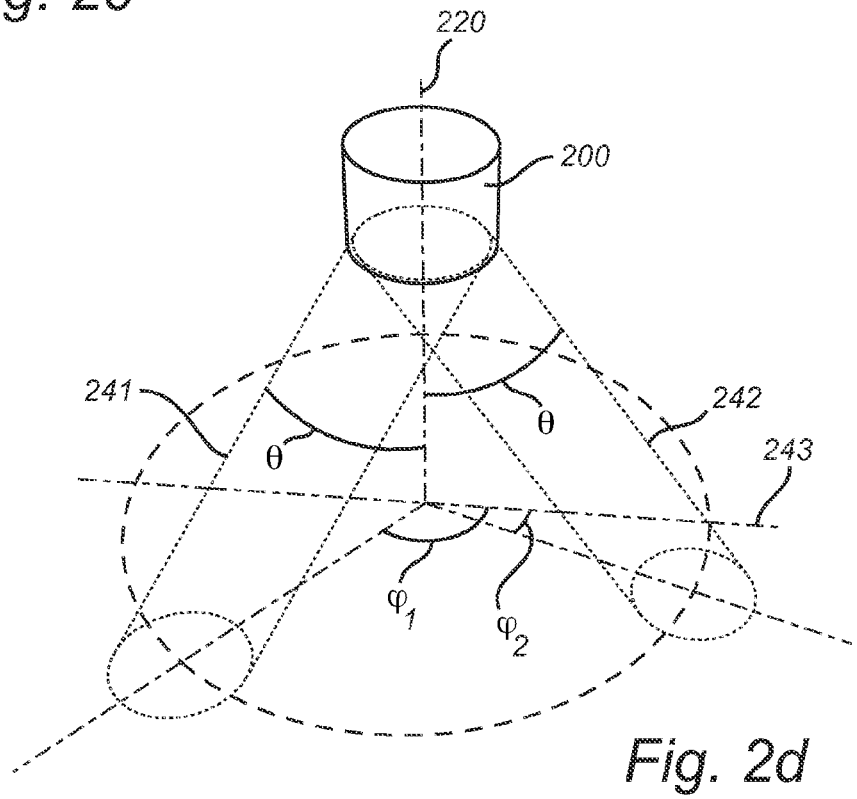

FIG. 2*d* further illustrates an embodiment of the light-output device 200 wherein the first and second angular ranges of light are fixed around a given polar angle $\theta$ with reference to the optical axis 220, whilst the first angular range 241 of light represents light centered around a first azimuth angle $\phi_1$, with reference to an azimuth axis 243, and the second angular range 242 of light represents light centered around a second azimuth angle $\phi_2$ with reference to an azimuth axis 243. Thereby, the light-beam emitted by the light-output device can be swept around the optical axis 220 of the light-output device.

Figure 3:
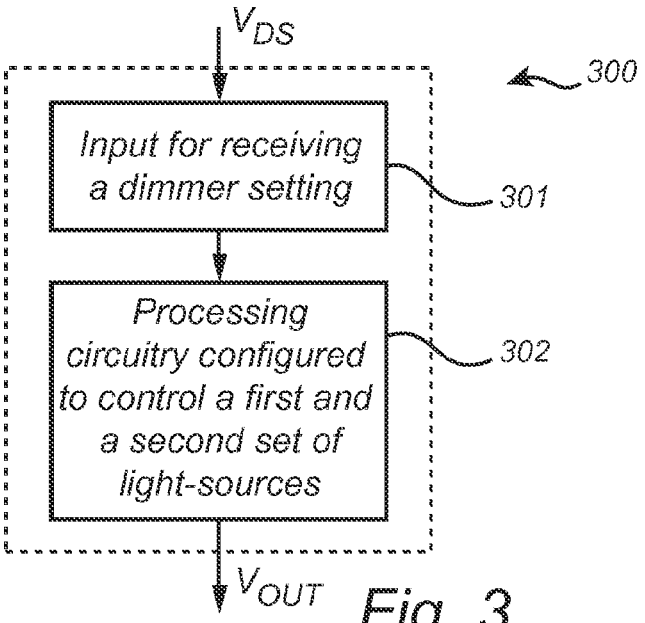
FIG. 3 schematically illustrates an exemplary embodiment of a control unit according to the present invention.

One embodiment of a control unit according to the invention is schematically shown in FIG. 3, wherein the control unit 300 comprises an input 301 for receiving a dimmer setting $V_{DS}$ and processing circuitry 302 configured to control, according to the inventive method of the invention, a first set of light-sources to emit light in a first angular range and second set of light-sources to emit light in a second angular range. As discussed above, the set of light-sources of the light-output device may be powered through an external AC power supply rather than by the variable AC waveform representing the dimmer setting, and so the output $V_{out}$ from the process circuitry may be configured to control the power supply from, for example, a ceiling junction box which is connected to the mains AC power, to the respective first and second set of light-sources.

Figure 4:
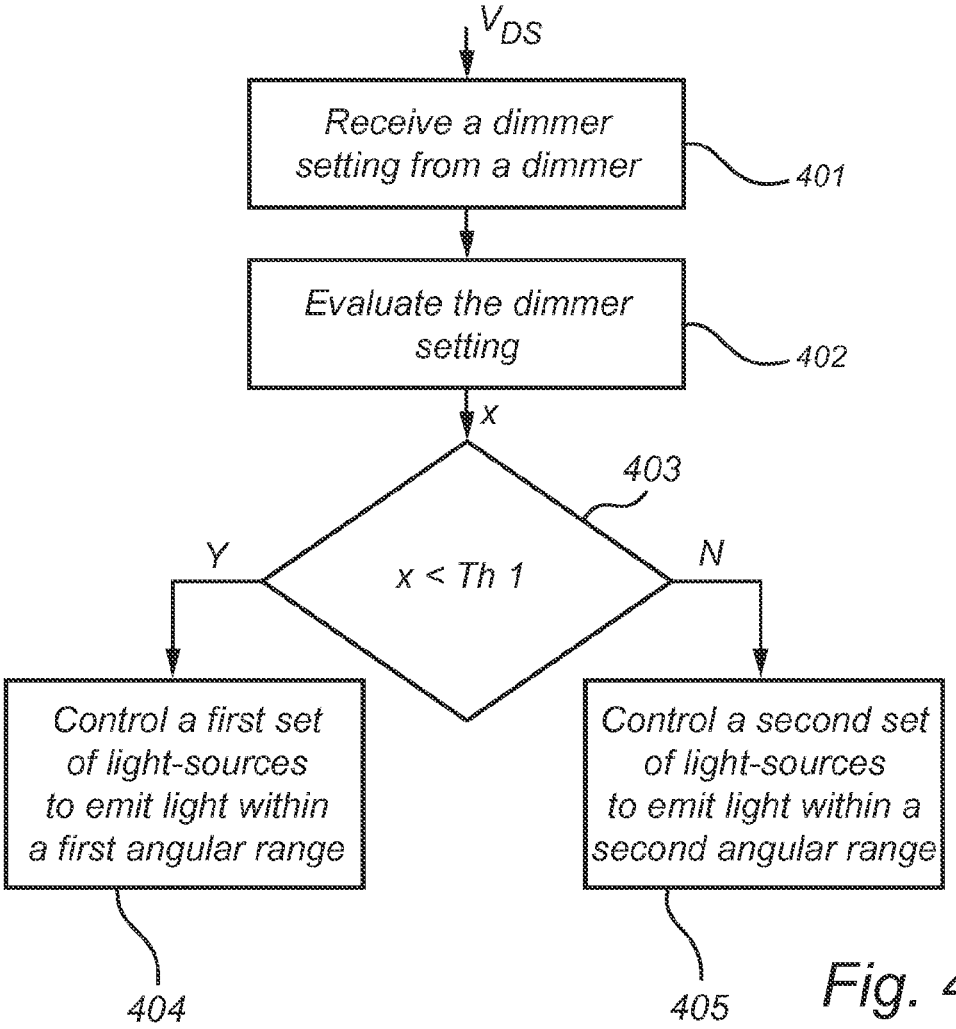
FIG. 4 is a flow-chart schematically illustrating an embodiment of the method for controlling an angular light distribution of a light-beam emitted by a light-output device according to the present invention.

An exemplary embodiment of the inventive method for controlling the angular distribution of a light-beam emitted by a light-output device will now be elucidated with reference to FIG. 4. In the first step 401 a dimmer setting $V_{DS}$ from a dimmer is received. As described above, the dimmer may be a conventional dimmer switch, which is known to the skilled person in the art, giving a dimmer setting which may be a duty cycle varied alternating current sine waveform. In the next step 402, the dimmer setting is evaluated using, for example, a look-up table wherein each possible dimmer setting represents a given value X corresponding to the duty cycle of the received dimmer setting i.e. corresponding to a given percentage of the total sine waveform. In the following step 403, as is schematically shown in FIG. 4, the generated value X is further evaluated. If the value X is lower than a first predetermined threshold Th1, then a first set of light-sources is controlled to emit light within a first angular range in step 404, and, if the value X is higher than a first predetermined threshold Th1, then a second set of light-sources is controlled to emit light within a second angular range in step 405.

Typically, it is desirable to control more than the two sets of light-sources described above, and so further steps may of course follow the step 403 wherein the value X is further evaluated against predetermined threshold ranges each corresponding to control of a given set of light-sources.

Additionally, variations to the disclosed embodiments can be understood and effected by the skilled person in practicing the claimed invention, from a study of the drawings, the disclosure, and the appended claims. For example, the light-output device may comprise both light-sources which comprise optical elements and light-sources which do not comprise optical elements, and the light-output device may virtually be of any desirable shape and design known the skilled person. Furthermore, the inventive method may be used to control a plurality of light-output devices.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage.

The invention claimed is:

1. A method for controlling an angular distribution of a light beam emitted by a light-output device comprising a first light-source configured to emit light within a first angular range, and a second light-source configured to emit light within a second angular range, wherein said first angular range is different from said second angular range, the method comprising the steps of:

receiving a dimmer setting (VDS) from a conventional dimmer switch having two regions, the dimmer setting being indicative of a duty cycle of mains power;

controlling, if said dimmer setting is within a first predetermined range corresponding to a first of the two regions, said first light source to emit light within said first angular range using a power source that is not in electrical communication with the dimmer switch; and controlling, if said dimmer setting is within a second predetermined range corresponding to a second of the two regions, said second light source to emit light within said second angular range using a power source that is not in electrical communication with the dimmer switch.

2. The method according to claim 1, wherein the intensity of the light emitted from said first and second light sources is variable within the respective first and respective second predetermined range, to allow for a continuous transition from emitting light within said first angular range to emitting light within said second angular range.

3. The method according to claim 1, wherein said first and said second angular range correspond to a first polar angle range and a second polar angle range, respectively, with reference to an optical axis of the light-output device.

4. The method according to claim 3, wherein said first and said second angular range correspond to a first azimuth angle range and a second azimuth angle range, respectively, with reference to an azimuth axis of the light-output device.

5. A method as in claim 1 wherein the total amount of power supplied to the first light source and the second light source remains constant as the dimmer setting changes from the first predetermined range to the second predetermined range.

6. A method as in claim 1 wherein the first angular range corresponds to a beam of emitted light having a first circumference and the second angular range corresponds to a beam of emitted light having a second circumference, the second circumference being wider than the first circumference.

7. A control unit for controlling an angular distribution of a light beam emitted by a light output device, the light output device comprising a first light source (105, 211) configured to emit light within a first angular range (221, 231, 241) and a second light source (107, 210) configured to emit light within a second angular range (222, 232, 242), said control unit comprising:

an input (301) for receiving a dimmer setting (VDS) from a conventional dimmer switch (101) having two regions, wherein said dimmer setting (VDS) is indicative of a duty cycle of mains power; and processing circuitry (302) configured to:

if said dimmer setting is within a first predetermined range corresponding to a first of the two regions, control (404) said first light source configured to emit light within said first angular range using a power source that is not in electrical communication with the dimmer switch; and if said dimmer setting is within a second predetermined range corresponding to a second of the two regions, control (405) said second light source configured to emit light within said second angular range using a power source that is not in electrical communication with the dimmer switch.

8. A light-output device comprising:

a first set of light-sources comprising at least one light-source configured to emit light within a first angular range and a second set of light-sources comprising at least one light-source configured to emit light within a second angular range, and the control unit according to claim 7 for controlling an angular distribution of a light-beam emitted by said light-output device.

9. A light-output device according to claim 8, wherein at least one of said first and said second set of light-sources comprises an optical element configured to redirect light from said first and/or said second set of light-sources to said first and/or said second angular range.

10. A light-output device according to claim 8, wherein said first and/or said second set of light-sources comprises at least one LED.

11. A light-output device according to claim 10, wherein said control unit further comprises a mains power input, thus electrically connectable to an AC mains power for powering said first or said second set of light-sources.

12. A light-output device according to 11, wherein said dimmer setting is used to regulate the power supply from said AC mains power to said first and second set of light-sources.

13. A lighting system comprising:

a light-output device according to claim 12; and a dimmer for enabling user control of said angular light distribution from said light-output device.

14. A control unit as in claim 7 wherein the total amount of power supplied to the first light source and the second light source remains constant as the dimmer setting changes from the first predetermined range to the second predetermined range.

15. A control unit as in claim 7 wherein the first angular range corresponds to a beam of emitted light having a first circumference and the second angular range corresponds to a beam of emitted light having a second circumference, the second circumference being wider than the first circumference.

* * * * *